United States Patent [19]

Tuchida

[11] 4,449,659

[45] May 22, 1984

[54] ROLLER FOR ADJUSTING THE WIDTH OF A TRAVELLING WEB

[76] Inventor: Isamu Tuchida, No. 1-24, Ōyamasakihiroshiki, Ōyamasaki-cho Otokuni-gun, Kyōto-fu, Japan

[21] Appl. No.: 384,425

[22] Filed: Jun. 2, 1982

[51] Int. Cl.[3] ..... B65H 17/20

[52] U.S. Cl. ..... 226/190; 226/199

[58] Field of Search ..... 226/190–192, 226/199; 271/240, 248, 250–253

[56] References Cited

U.S. PATENT DOCUMENTS 3,095,131 6/1963 Robertson et al. ..... 226/190

FOREIGN PATENT DOCUMENTS 283691 9/1962 Netherlands ..... 226/192

*Primary Examiner*—Leonard D. Christian

*Attorney, Agent, or Firm*—Larson and Taylor

[57] ABSTRACT

In a roller for adjusting the width of a travelling web including a core roller, a pair of inclinedly movable tension setting members disposed at the ends of the core roller, and a plurality of elastic bands having a proper amount of surface frictional resistance axially arranged in a cylindrical shape around the core roller between the tension setting members, the elastic bands are connected to the tension setting members through universal joints. The provision of such universal joints prevents the joint portions of the elastic bands from being bent or twisted when the roller is rotated wth the elastic bands axially moved in such direction as to adjust the width of a web, according to the inclined movement of the tension setting members.

4 Claims, 4 Drawing Figures

ROLLER FOR ADJUSTING THE WIDTH OF A TRAVELLING WEB

BACKGROUND OF THE INVENTION

There is conventionally known a roller for properly adjusting the width of a travelling web by expanding or contracting the web to a predetermined position whereby the web undergoes a change in width. The roller of the type abovementioned includes a core roller, a pair of inclinedly movable tension setting members of short cylindrical shape disposed at the ends of the core roller, and a plurality of elastic bands having a proper amount of surface frictional resistance axially arranged in the cylindrical shape around the circumference of the core roller between the tension setting members.

The cylindrically arranged elastic bands are axially moved in succession according to the inclined movement of the tension setting members, while being rotated by the contact of a travelling web therewith. Thus, the web is expanded or contracted to the predetermined position, whereby the travelling web is properly adjusted in width.

According to the adjusting roller of this type, the elastic bands are connected to the tension setting members with the ends of the elastic bands secured to the peripheries of the tension setting members. It is therefore unavoidable that the joint ends of the elastic bands will be bent or twisted, as the elastic bands are axially moved expanded or contracted, according to the inclined movement of the tension setting members when adjusting the web width. This presents disadvantages as follows:

(1) Since rotating torque greater than necessary is required for rotating the roller, no smooth width adjustment of a travelling web can be performed.

(2) The bent or twisted portions of the elastic bands are apt to be damaged. When the elastic bands are repeatedly bent or twisted, they are broken, thereby to reduce the life-time of the adjusting roller.

(3) When the elastic bands are broken, there is produced powder from the material forming the elastic bands, such as rubber powder. Such powder sticks to the web, and the web is subsequently contaminated.

SUMMARY OF THE INVENTION

The present invention relates to improvements in a roller for adjusting the width of a travelling web of the type abovementioned. More particularly, the present invention relates to a roller for properly adjusting the width of a travelling web by expanding or contracting the web to the predetermined position so that the web undergoes change in width, in which the elastic bands are stretchingly secured, through universal joints, to the tension setting members disposed at the both ends of the elastic bands.

It is a main object of the present invention to provide a roller for adjusting the width of a travelling web, in which, even if the tension setting members are inclinedly moved and rotated as inclinedly moved, the joint portions of the elastic bands are neither bent nor twisted, so that the roller requires no extra rotary torque but may be smoothly rotated to perform a predetermined web width adjustment.

It is another object of the present invention to provide a roller for adjusting the width of a travelling web, in which, even if a travelling web width adjustment is performed with the tension setting members frequently moved as inclined, the joint portions of the elastic bands are not broken, thereby to improve the life-time of the roller, as well as to prevent powder of the material forming the elastic bands such as rubber powder from being produced, such powder sticking to and contaminating the web.

A roller for adjusting the width of a travelling web in accordance with the present invention includes: a core member; a pair of inclinedly movable tension setting members disposed at the both ends of the core member; and a plurality of elastic bands having a proper amount of surface frictional resistance axially arranged in a cylindrical shape around the circumference of the core member between the tension setting members; the cylindrically arranged elastic bands being axially moved (expanding or contracting) in succession according to the inclined movement of the tension setting members, while being rotated by the contact of a travelling web therewith; such moving rotation of the elastic bands causing the web to be moved (expanded or contracted) to the predetermined position so as to properly adjust the width of the travelling web: and is characterized in that the elastic bands are stretchingly secured at the both ends thereof to the tension setting members through universal joints.

According to the roller for adjusting the width of a travelling web of the present invention, the elastic bands are secured at the ends thereof to the tension setting members through the universal joints so as to be changed in angle with respect to the tension setting members. Accordingly, when the tension setting members are inclinedly moved and are rotated as inclinedly moved, the joint portions of the elastic bands are smoothly changed in angle with respect to the tension setting members without the smallest strain. Thus, the joint portions of the elastic bands are neither bent nor twisted as done in a conventional adjusting roller in which the ends of the elastic bands are secured directly to the tension setting members. Therefore, without the necessity of extra rotary torque, the roller can be smoothly rotated to achieve a predetermined width adjustment of a travelling web.

Moreover, even if a travelling web is continuously adjusted in width with the tension setting members frequently moved as inclined, the provision of the universal joints can prevent the joint portions of the elastic bands from being broken, thereby to improve the lifetime of the adjusting roller. Since the elastic bands are not broken, there is not produced powder from the material forming the elastic bands, such as rubber powder which sticks to and contaminates the web.

BRIEF DESCRIPTION OF THE DRAWINGS

The present invention will be further described, by way of example, with reference to the accompanying drawings in which.

DETAILED DESCRIPTION OF THE PREFERRED EMBODIMENT

Figure 1:
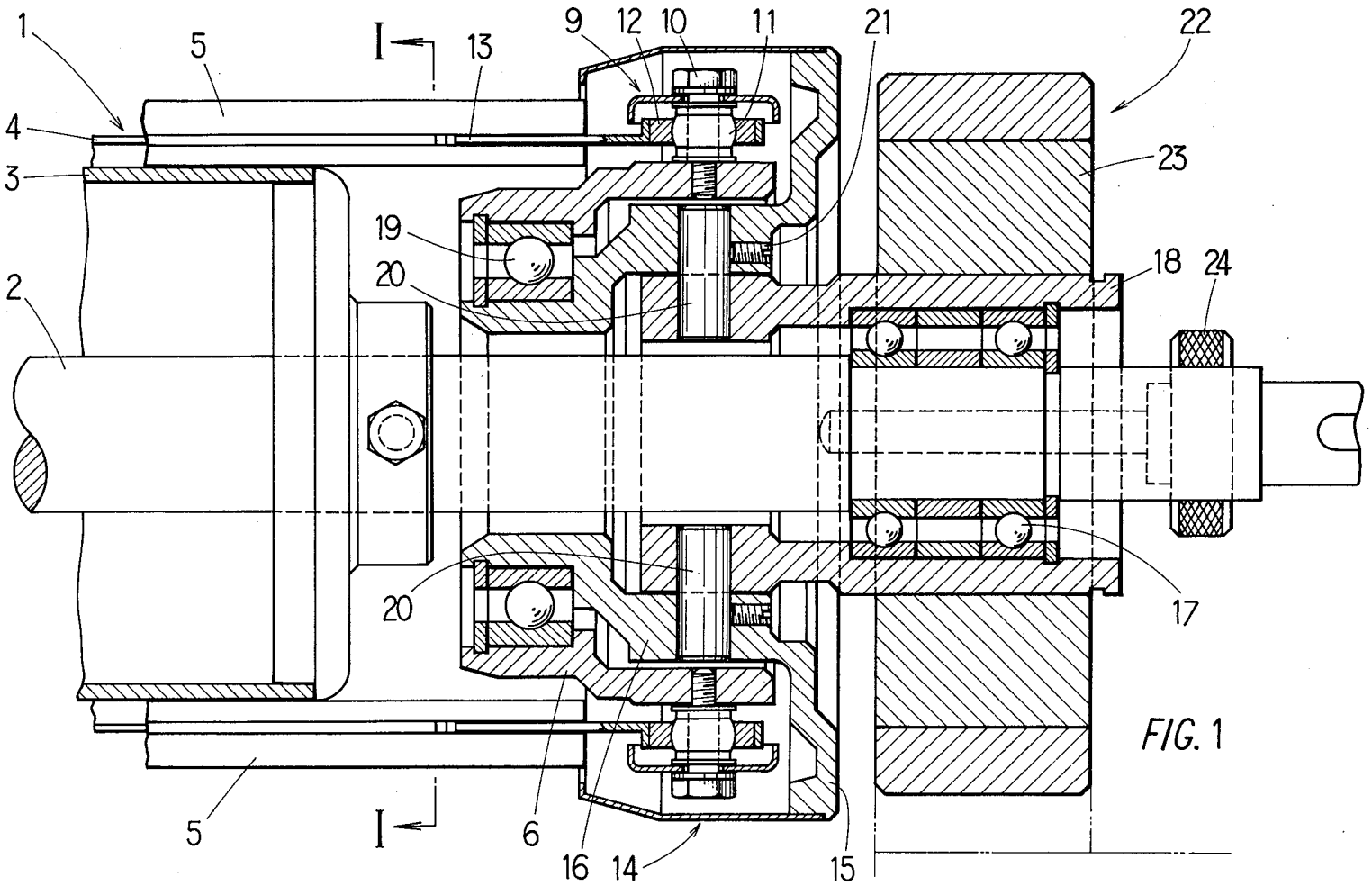
FIG. 1 is a section view of main portions of a roller in accordance with the present invention.

A roller for adjusting the width of a travelling web in accordance with the present invention comprises a roller body, supporting members of tension setting members in the roller body, and mounting members of the roller body and the supporting members.

The roller body 1 includes a core member or a hollow roller 3 rotatably supported by a shaft 2, a plurality of elastic bands 5 axially arranged in a cylindrical shape around the circumference of the core member 3 with a plurality of connecting members 4 made of metallic plates, and a pair of tension setting members 6 of short cylindrical shape to which the elastic bands 5 are connected as stretched. The tension setting members 6 are so constructed as to be inclinedly movable by the mounting members and the supporting members to be discussed later.

Figure 2:
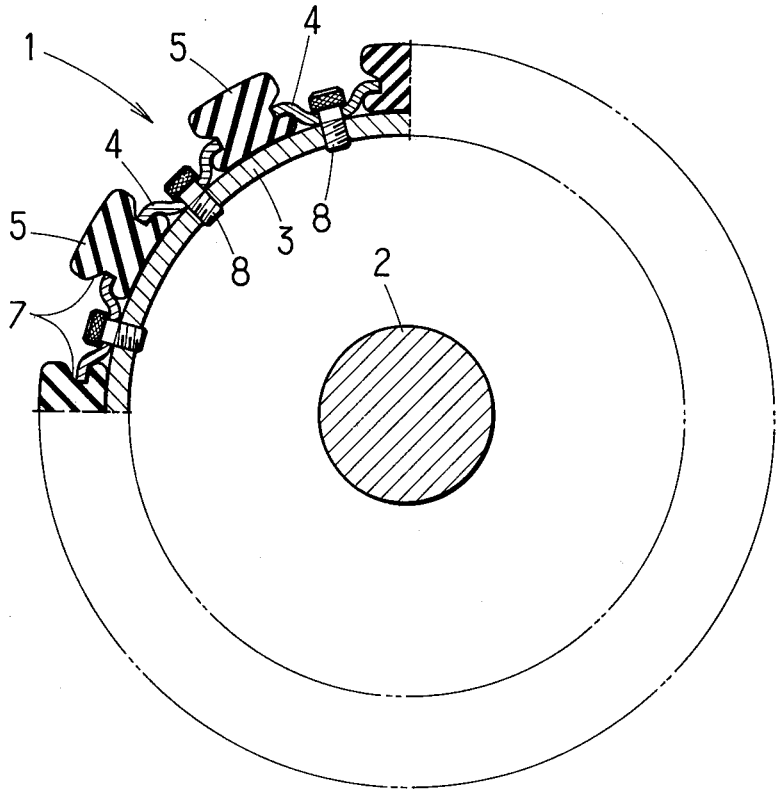
FIG. 2 is a section view, with portions omitted, taken along the line I—I in FIG. 1.
Figure 3:
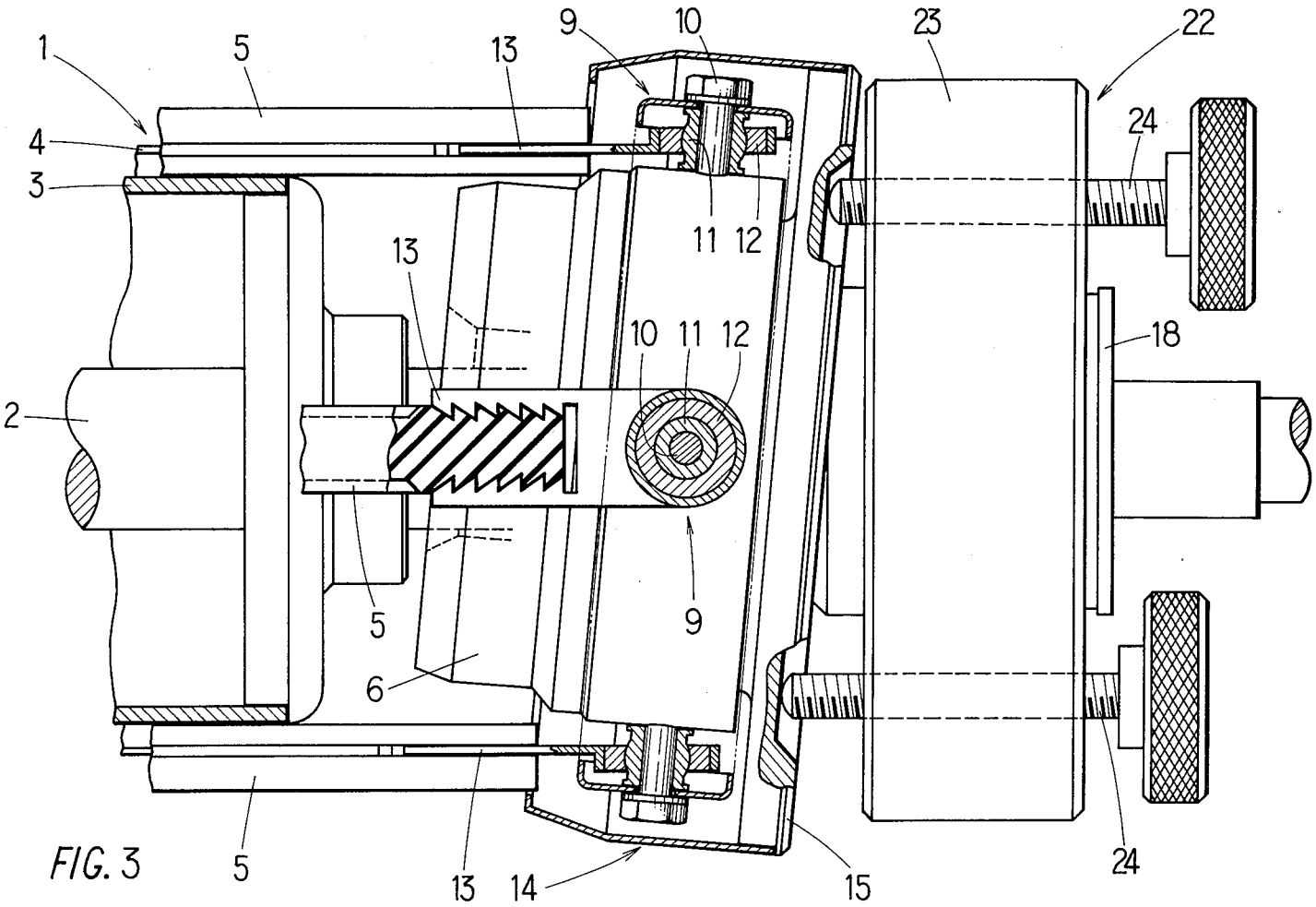
FIG. 3 is a view illustrating the associated movement of elastic bands according to the inclined movement of tension setting member.

The elastic bands 5 may be made of rubber having a proper amount of surface frictional resistance. As shown in FIG. 2, the side edges of the connecting members 4 are fitted into grooves 7 formed in the both lateral sides of the elastic bands 5 in the longitudinal direction thereof, and the connecting members 4 are rigidly secured to the core member 3 with bolts 8. Thus, the elastic bands 5 are arranged in a cylindrical shape around the circumference of the core member 3. The elastic bands 5 are so constructed as to be movable (expanded or contracted) in the axial direction of the core member 3 with the connecting members 4 not restricting the axial movement of the elastic bands 5. Both ends of each elastic band 5 are connected to the outer peripheries of the tension setting members 6 through universal joints such that the elastic bands 5 are changed in angle with respect to the tension setting members 6.

Each of the universal joints 9 has a spherical member 11 secured to the outer periphery of the tension setting member 6 with a pin 10, a socket 12 covering the spherical member 11 in a spherical contact manner, and a connecting piece 13 for connecting the socket 12 to the end of the elastic band 5.

Each of the supporting members 14 of the tension setting members 6 has a short cylindrical support 16 provided at the outside thereof with a flange 15, and a hollow support shaft 18 inserted into the cylindrical support 16 and supported by the shaft 2 through bearings 17. With the cylindrical supports 16 inserted into the tension setting members 6 from the outside, the supporting members 14 support the tension setting members 6 through bearings 19 such that the tension setting members 6 are rotatable.

Each of the hollow support shafts 18 is mounted to each of the cylindrical supports 16 with two pins 20 inserted into the hollow support shaft 18 in the diametrically opposite directions and two fixing screws 21. With these pins 20 as rotating shafts, the cylindrical supports 16 and the tension setting members 6 are rotatable at the same time.

Each of the mounting members 22 has a mounting ring 23 fittingly secured to the outer periphery of the hollow support shaft 18 and two screws 24 threadedly inserted into the mounting ring 23 in the axial direction of the roller body. In order to inclinedly move the tension setting members 6, the screws 24 are threadedly inserted into the mounting ring 23 as displaced by 90° with respect to the pins 20. The tips of the screws 24 are in contact with the surfaces of the flanges 15 of the cylindrical supports 16 in an axially movable manner.

Figure 4:
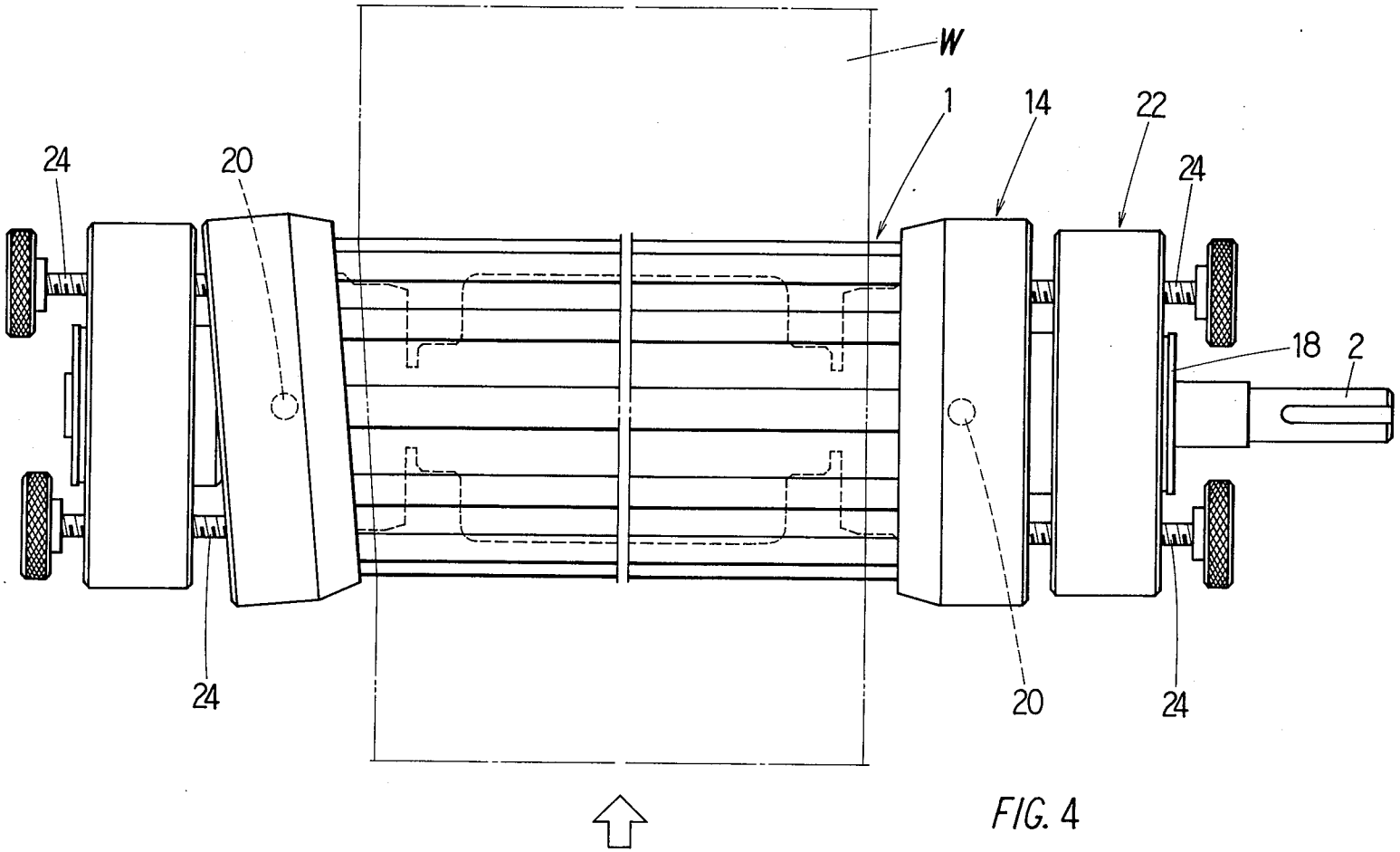
FIG. 4 is a front view, with portions omitted, illustrating how to use the roller in accordance with the present invention.

As shown in FIG. 4, the roller for adjusting the width of a travelling web as discussed hereinbefore is used with the cylindrically arranged elastic bands rotated by the contact of a travelling web W with the surfaces of the elastic bands 5. Accordingly, to change the width of the travelling web, the screws 24 are adjusted to inclinedly move the tension setting members 6 in the direction to correct such change. Then, the elastic bands 5 are axially moved (expanded or contracted) so as to properly adjust the web width.

Even if the tension setting members 6 are inclinedly moved, there is no possibility of the joint portions of the elastic bands 5 being bent or twisted. The cylindrically arranged elastic bands 5 are smoothly rotated as moved while being held as straightly stretched through the universal joints 9, whereby a predetermined web width adjustment is performed.

It will be apparent that the present invention is not limited to the embodiment discussed hereinbefore which is described merely by way of example, and numerous changes and modifications of the present invention may be included in the present invention without departing from the spirit of the invention and the appended claims.

What we claim is:

1. In a roller for adjusting the width of a travelling web including:

a core member;

a pair of inclinedly movable tension setting members disposed at the ends of said core members having a plurality of universal joints arranged adjacent to the periphery of the roller; and a plurality of elastic bands having surface frictional resistance which are axially arranged in a cylindrical shape around the circumference of said core member and stretchingly held between said tension setting members to which said bands are attached at each end;

said cylindrically arranged elastic bands being axially moved in succession according to the inclined movement of said tension setting members, while being rotated by the contact of the travelling web with said elastic bands, the axial movement during rotation of said cylindrically arranged elastic bands causing the web to be similarly axially moved to a predetermined position, thereby to properly adjust the width of the travelling web;

said roller characterized in that the both ends of said elastic bands are connected to said tension setting members through said universal joints.

2. The roller for adjusting the width of a travelling web as set forth in claim 1, wherein said tension setting members are short cylindrical members, and said core member is a hollow roller.

3. The roller for adjusting the width of a travelling web as set forth in claim 1, and further including connecting members located on said core member by which said plurality of elastic bands are arranged in a cylindrical shape.

4. The roller for adjusting the width of a travelling web as set forth in claim 1, wherein each of said universal joints includes a spherical member, and a socket covering said spherical member is a spherical contact manner.

* * * * *